US006836624B2

(12) United States Patent
Suzuki

(10) Patent No.: US 6,836,624 B2
(45) Date of Patent: Dec. 28, 2004

(54) IMAGE FORMING APPARATUS THAT DETECTS A CONVEYING LOAD FOR CONVEYING A SHEET

(75) Inventor: Kazuhiro Suzuki, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/273,347

(22) Filed: Oct. 18, 2002

(65) Prior Publication Data

US 2004/0076442 A1 Apr. 22, 2004

(51) Int. Cl.[7] ..... G03G 15/00
(52) U.S. Cl. ..... 399/44; 399/45; 399/38 G
(58) Field of Search ..... 271/265.04; 399/44, 399/45, 46, 66, 67, 94, 97, 38 G, 30

(56) References Cited

U.S. PATENT DOCUMENTS 6,493,523 B2 * 12/2002 Weaver ..... 399/45

FOREIGN PATENT DOCUMENTS

JP 7-101594 A 4/1995

* cited by examiner

*Primary Examiner*—Hoang Ngo
(74) *Attorney, Agent, or Firm*—Foley & Lardner LLP

(57) ABSTRACT

An image forming apparatus according to the present invention includes: a discrimination circuit for detecting a conveying load at a time a sheet, on which an image is to be formed, is conveyed through a curved conveying path, for discriminating a thickness of the sheet based on a detected value of the conveying load, and for generating a process control signal in order to carry out a process control suitable for the thickness of the sheet based on the discriminated thickness; and a process control circuit for carrying out the process control suitable for the thickness of the sheet in response to the process control signal received.

6 Claims, 5 Drawing Sheets

IMAGE FORMING APPARATUS THAT DETECTS A CONVEYING LOAD FOR CONVEYING A SHEET

BACKGROUND OF THE INVENTION

1. Field of the Invention

The present invention relates to an image forming apparatus such as a copying machine, a complex machine including a copying machine, facsimile, and printer, etc.

2. Background of the Invention

Image forming apparatuses include copying machines for copying original images, and multifunction peripherals (MFPs) each having functions of a copying machine, a facsimile, a printer, etc. Sometimes, these copying machines and MFPs are used to print images on special paper such as thick paper, instead of ordinary paper. When thick paper is printed on as special paper, the settings of the copying machines and the MFPs should be changed to the "thick paper print setting." In the thick paper print setting, the process conditions such as the transfer condition, the charging condition, the fixing condition, etc. are changed from those for ordinary paper to those for thick paper. Conventionally, such thick paper print settings have been adjusted by users.

However, there is a case where a user determines wrongly whether the paper to be printed on is ordinary paper or thick paper, resulting in that he/she does not implement the thick paper print setting when thick paper is used for the printing. In this case, many problems may arise due to the differences between the process conditions for thick paper and the process conditions for ordinary paper. For example, sometimes an image printed on thick paper is thinner than the original image to be copied; sometimes, there is a white portion, to which toner is not adhered, in an image printed on thick paper; and sometimes the appearance of a printed image is inferior to and dirtier than that of the original image.

SUMMARY OF THE INVENTION

The present invention is proposed in view of the above-described problems, and the object of the present invention is to automatically discriminate the thickness of a sheet of paper being conveyed, and to carry out a process control suitable for the thickness of the sheet of paper.

An image forming apparatus according to the present invention includes: a discrimination circuit for detecting a conveying load at a time a sheet, on which an image is to be formed, is conveyed through a curved conveying path, for discriminating a thickness of the sheet based on a detected value of the conveying load, and for generating a process control signal in order to carry out a process control suitable for the thickness of the sheet based on the discriminated thickness; and a process control circuit for carrying out the process control suitable for the thickness of the sheet in response to the process control signal received.

DESCRIPTION OF THE PREFERRED EMBODIMENTS

First, characteristic features of the embodiment of the present invention will be briefly described below.

In the embodiment of the present invention, the thickness of paper being conveyed is discriminated by detecting the conveying load of the paper when the paper, on which an image is to be formed, is vertically conveyed. Then, the process conditions suitable for the thickness of the paper being conveyed are set based on the discrimination result. Next, according to the set process conditions, an image is formed on the paper. Hereinafter, the embodiment of the present invention will be described in detail.

Figure 1:
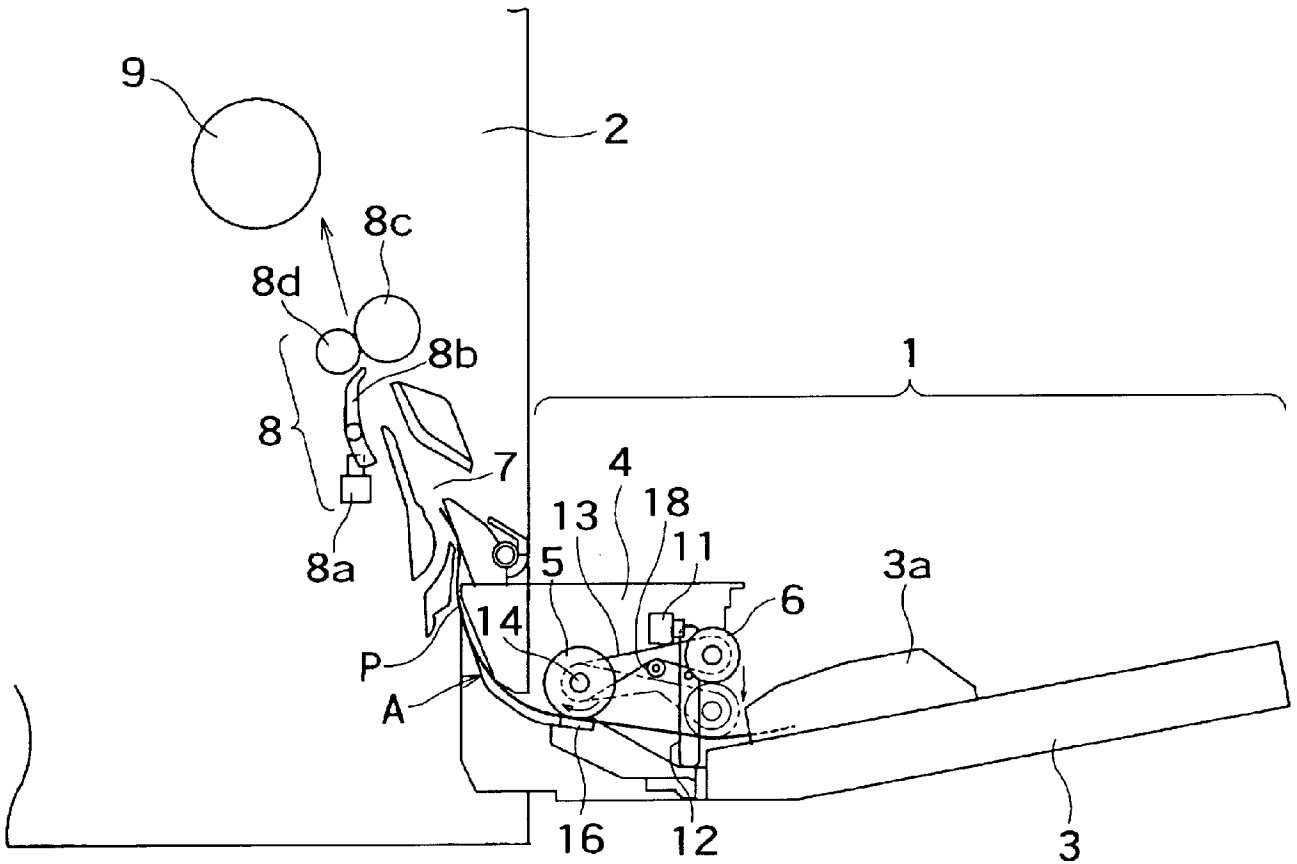
FIG. 1 is a sectional view for explaining the structure and operation of a manual paper feeding unit and its peripherals of an MFP according to an embodiment of the present invention.
Figure 2:
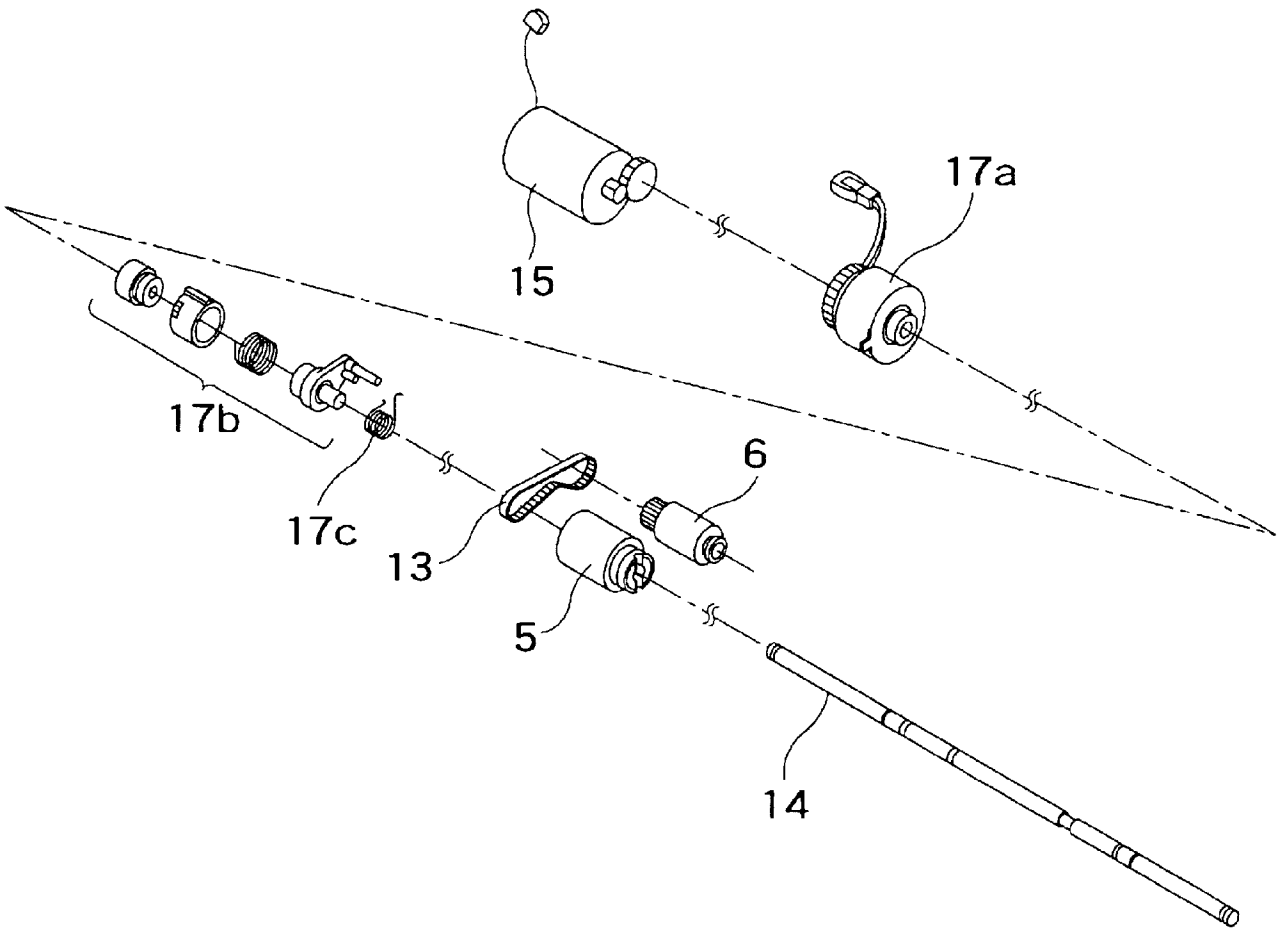
FIG. 2 is a partial exploded view of a driving section of the manual paper feeding unit shown in FIG. 1.

FIG. 1 is a sectional view for explaining the structure and operation of a manual paper feeding unit and its peripherals of a multifunction peripheral (MFP) according to an embodiment of the present invention. In the present specification, an MFP is an apparatus having functions of a copying machine, a facsimile, a printer, etc., all in a single unit. As can be understood from FIG. 1, the MFP employs a vertical conveying system, with which it is possible to minimize the size and reduce the first copy time. FIG. 2 is a partial exploded view of a driving section of the manual paper feeding unit shown in FIG. 1.

As can be understood from FIG. 1, in the MFP, a sheet of paper set in a manual paper feeding tray 3 is sent to a resist section 8 via a vertical conveying path 7 by a driving section 4. An electrostatic latent image formed on the surface of a photoconductive member 9 is transferred to the sheet of paper to ultimately form an image thereon. This will be described in more detail below.

First, the structure of the MFP will be described below.

As shown in FIG. 1, the MFP includes a manual paper feeding unit 1 for setting and feeding special paper such as thick paper (e.g., 128, 158, or 209 g/m$^2$), thin paper (e.g., 50 g/m$^2$), OHP sheets, etc. Although ordinary paper (e.g., 64–80 g/m$^2$) is usually fed by a cassette paper feeding unit (not shown) placed within a main section 2, it is possible for ordinary paper to be also fed by the manual paper feeding unit 1 and be printed on. The manual paper feeding unit 1 is composed of the manual paper feeding tray 3 and the driving section 4.

The manual paper feeding tray 3 is for setting the sheet of paper on which an image is formed. A pair of sidewalls 3*a* for supporting the set paper from both sides is attached to the manual paper feeding tray 3.

The driving section 4 is for conveying the sheet of paper set in the manual paper feeding tray 3 toward the resist section 8. As shown in FIG. 1, the driving section 4 includes a paper feeding sensor actuator 12 and a paper feeding sensor 11 for detecting the existence of the paper set in the manual paper feeding tray 3. As can be understood from FIG. 1, an end portion of the paper feeding sensor actuator 12 is pushed toward the left side in the drawing due to the weight of the paper set in the manual paper feeding tray 3. As the paper feeding sensor actuator 12 is pushed, the paper feeding sensor 11 is turned on. The paper feeding sensor 11 is connected to the main section 2, by which the ON/OFF state of the paper feeding state is recognized.

As shown in FIG. 1, the driving section 4 includes a pick-up roller 6 for picking up the uppermost sheet of paper from the stack of sheets paper set in the manual paper feeding tray 3. Further, the driving section 4 includes a paper feeding roller 5 for conveying the picked-up sheet of paper to the resist section 8.

As can be understood from FIG. 2, a motor 15 for rotating the paper feeding roller 5 is provided to the driving section 4. The motor 15 can be any kind of DC motor and AC motor. The motor 15 is connected to a clutch 17*a* via a connecting member, which is not shown. The clutch 17*a* is connected to a paper feeding roller shaft 14 for conveying the driving force of the motor 15 to the paper feeding roller 5. That is, whether or not the driving force of the motor 15 is conveyed to the paper feeding roller shaft 14 is determined by the ON/OFF states of the clutch 17*a*.

As shown in FIG. 2, the paper feeding roller shaft 14 penetrates the paper feeding roller 5. Further, the pick-up roller 6 is wound by a belt 13 together with the paper feeding roller 5. With such a structure, the pick-up roller 6 is rotated in conjunction with the paper feeding roller 5. As shown in FIG. 1, a tension roller 18 is positioned so as to contact the belt 13, so that the belt 13 is not loosened.

As shown in FIG. 2, the paper feeding shaft 14 also penetrates a spring clutch 17*b*, which is opened by the rotation of the paper feeding roller shaft 14, resulting in that the pick-up roller 6 falls in the direction of the arrow due to its own weight, as shown in FIG. 1. That is, in the non-printing state, the spring clutch 17*b* supports the pick-up roller 6 at an upper position, and in the printing state, the spring clutch 17*b* drops the pick-up roller 6 as shown in FIG. 1. A pick-up roller push-up spring 17*c* for moving the dropped pick-up roller 6 back to the original position is also penetrated by the paper feeding roller shaft 14.

As shown in FIG. 1, the paper feeding roller 5 contacts a separating pad 16 for separating only one sheet of paper when some of the sheets of paper set in the manual paper feeding tray 3 are simultaneously picked up, overlapping one another.

Next, as shown in FIG. 1, the MFP includes the main section 2, to the exterior housing of which the manual paper feeding unit 1 is attached.

As shown in FIG. 1, the main section 2 includes a vertical conveying path 7 serving as a path connecting the manual paper feeding tray 3 and the resist section 8. The sheet of paper sent from the manual paper feeding tray 3 by the driving section 4 passes through the vertical paper conveying path 7 toward the resist section 8.

As shown in FIG. 1, the main section 2 includes the resist section 8, which timely sends the received sheet of paper to the photoconductive member 9 so as to align the sheet of paper with the electrostatic latent image formed on the surface of the photoconductive member 9. In more detail, the resist section 8 includes a resist sensor 8*a*, a resist actuator 8*b*, and resist rollers 8*c* and 8*d*. The sheet of paper having passed through the vertical conveying path 7 pushes up the tip of the resist actuator 8, thereby turning on the resist sensor 8*a*. The resist sensor 8*a* is connected to the clutch 17*a* shown in FIG. 2. When the resist sensor 8*a* is turned on, the clutch 17*a* is turned off, thereby stopping the rotations of the paper feeding roller 5 and the pick-up roller 6. The resist rollers 8*c* and 8*d* hold an end of the sheet of paper having pushed up the actuator 8*b*, and send the sheet of paper to the photoconductive member 9 in predetermined timings.

The operation of the MFP with the above-described structure will be described next.

As is understood from FIG. 1, a sheet of paper on which an image will be formed is set in the manual paper feeding tray 3. The end of the paper feeding sensor actuator 12 is pushed down to the left side in FIG. 1 due to the weight of the sheet of paper set in the manual paper feeding tray 3, thereby turning on the paper feeding sensor 11. When the paper feeding sensor 11 is turned on, the main section 2 recognizes that a sheet of paper is set in the manual paper feeding tray 3. In this state, if the user pushes down a print key button (not shown) of the main section 2, the paper feeding operation is started.

That is, as can be understood from FIG. 2, the motor 15 starts, and then the clutch 17*a* is turned on, resulting in that the driving force of the motor 15 is conveyed to the paper feeding roller shaft 14, thereby rotating the paper feeding roller shaft 14. In conjunction with the rotation of the paper feeding roller shaft 14, the paper feeding roller 5 penetrated by the paper feeding roller shaft 14 is rotated, thereby rotating the pick-up roller 6 wound by the belt 13 together with the paper feeding roller 5. On the other hand, as the paper feeding roller shaft 14 is rotated, the spring clutch 17*b* penetrated by the paper feeding roller shaft 14 is opened, resulting in that while still being rotated, the pick-up roller 6 falls, due to its own weight, on the uppermost sheet of paper P of the stack of sheets of paper set in the manual paper feeding tray 3, as can be understood from FIG. 1. Then, the sheet of paper P is picked up by the rotating pick-up roller 6 and sent to the paper feeding roller 5. Subsequently, the sheet of paper P is fed toward the resist section 8 by both the pick-up roller 6 and the paper feeding roller 5. After the sheet of paper P completely leaves the pick-up roller 6, only the paper feeding roller 5 continues to feed the sheet of paper P. After passing through the vertical conveying path 7 to reach the resist section 8, the sheet of paper P pushes up the tip portion of the resist actuator 8*b*, thereby turning on the resist sensor 8*a*, resulting in that the clutch 17*a* is turned off. As the clutch 17*a* is turned off, the rotation of the paper feeding roller 5 and the pick-up roller 6 is stopped. Further, when the clutch 17*a* is turned off, the pick-up roller 6 is returned to the original position by the pick-up roller push-up spring 18, as can be understood from FIG. 1. The movement of the sheet of paper P having pushed up the resist actuator 8*b* is stopped, and then the end thereof is held by the resist rollers 8*c* and 8*d*, as can be understood from FIG. 1. The resist rollers 8*c* and 8*d* send the sheet of paper P toward the photoconductive member 9 at a predetermined time.

As can be understood from FIG. 1, the sheet of paper P having been sent from the manual paper feeding tray 3 toward the resist section 8 is bent at an angled portion A of the vertical conveying path 7 when it is passing through the vertical conveying path 7 connecting the manual paper feeding tray 3 and the resist section 8. Accordingly, the load of the motor 15 shown in FIG. 2, e.g., the drive current value, increases by the amount required to bend the sheet of paper P. The amount of increase in the drive current value, i.e., the load of the motor, depends on what is being fed, for example, thick paper, ordinary paper, or thin paper. Hereinafter, this will be described in more detail.

Figure 3:
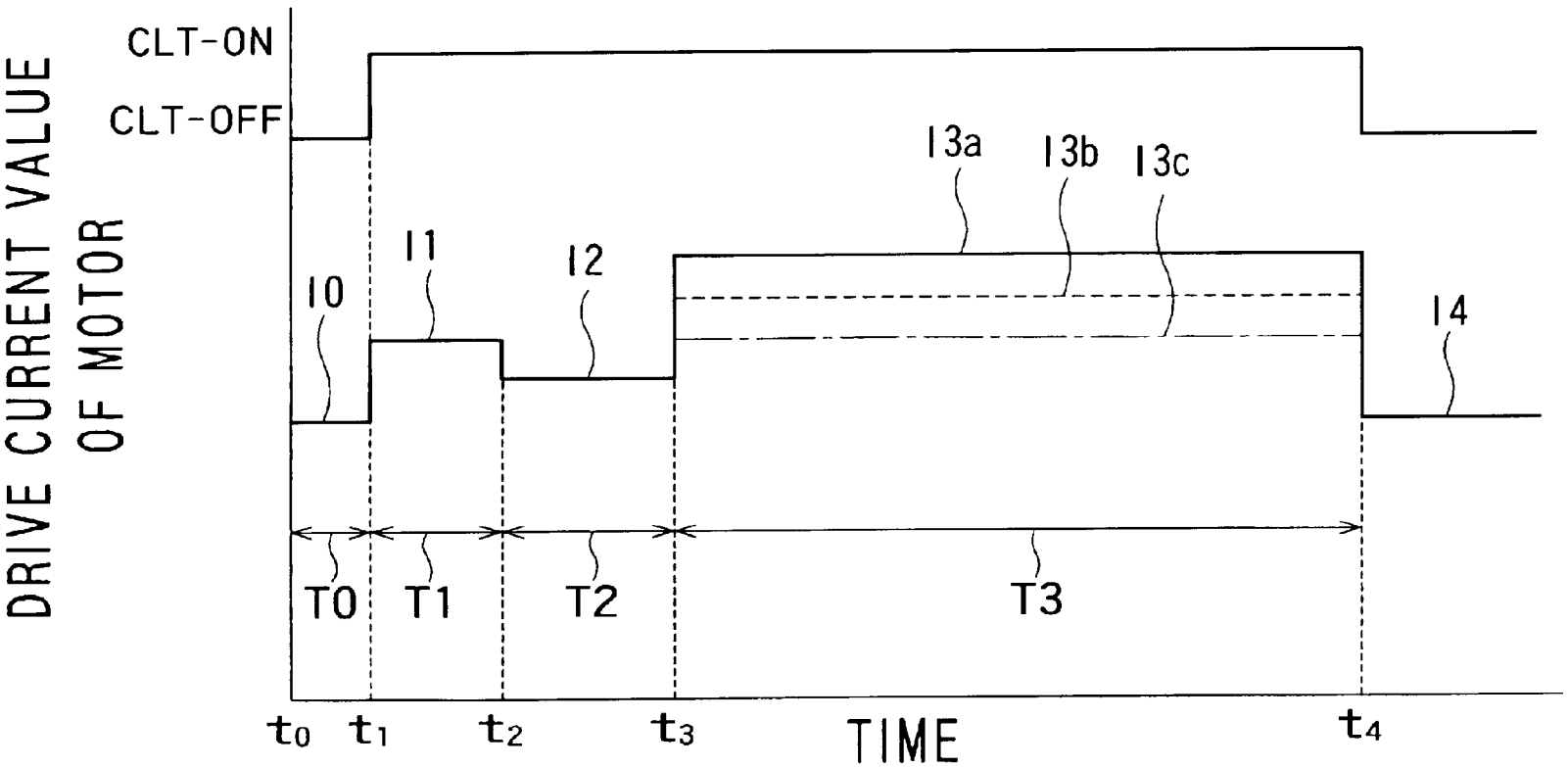
FIG. 3 shows transitions of drive current value of a motor when sheets of thick paper, ordinary paper, and thin paper are being fed in accordance with the lapse of time.

FIG. 3 shows the transitions of the drive current value of the motor 15 when thick paper, ordinary paper, and thin paper are fed from the manual paper feeding tray 3 to the resist section 8. The present inventor has drawn FIG. 3 based on their own experiments.

First, as can be understood from FIG. 1, sheets of thick paper, ordinary paper, and thin paper are set in the manual paper feeding tray 3. Then, the print key button (not shown) of the main section 2 is pushed to actuate the motor 15 shown in FIG. 2. This moment is shown as time t0 in FIG. 3. The drive current value of the motor 15 at this time is the drive current value I0 in FIG. 3.

As shown in FIG. 3, at time t1 , when a period T0 has passed from time t0 at which the motor 15 is actuated, the clutch 17*a* shown in FIG. 2 is turned on (CLT-ON). When the clutch 17*a* is turned on, the paper feeding roller 5 and the pick-up roller 6 are rotated, as can be understood from FIG. 2. The pick-up roller 6 picks up and sends a sheet of paper, as can be understood from FIG. 1. The sheet of paper having been picked up is fed by only the pick-up roller 6 during the period T1, i.e., from time 1 to time 2. That is, the sheet of paper does not reach the paper feeding roller 5 during the period T1, i.e., from time t1 to time t2. As a result, during the period T1, the paper feeding roller 5 is rotated contacting the separating pad 16, as can be understood from FIG. 1. In the period T1, the load of the motor 15 is increased due to the friction resistance of the separating pad 16 as compared with the period T0, which is before CLT-ON. Accordingly, as shown in FIG. 3, the drive current value I1 of the motor 15 during the period T1 is greater than the drive current value I0 of the motor 15 during the period T0, which is before CLT-ON.

As can be understood from FIG. 3, the sheet of paper fed by the pick-up roller 6 at time t1 reaches the paper feeding roller 5 at time t2 when the period T1 has passed from time t1. During the period T2, i.e., from time t2 at which the sheet of paper reached the paper feeding roller 5 to t3, the sheet of paper is horizontally fed by both the paper feeding roller 5 and the pick-up roller 6 to the position immediately before the vertical conveying path 7 shown in FIG. 1. As shown in FIG. 3, the drive current value I2 of the motor 15 during the period T2 is smaller than the drive current value I1 of the motor 15 during the period T1, in which only the pick-up roller 6 feeds the sheet of paper. That is, since the friction resistance of the sheet of paper is smaller than that of the separating pad 16 shown in FIG. 1, the load of the motor 15, i.e., the drive current value of the motor 15, is smaller in the period T2, during which the paper feeding roller 5 feeds the sheet of paper, than in the period T1 during which the paper feeding roller 5 rotates while contacting the separating pad 16.

As can be understood from FIG. 3, the sheet of paper having reached the paper feeding roller 5 at time t2 reaches the vertical conveying path 7 shown in FIG. 1 at time t3 when the period T2 has passed from time t2. The sheet of paper having reached the vertical conveying path 7 at time t3 is bent and sent through the vertical conveying path 7 to the resist section 8. Then, at time t4 when the period T3 has passed from time t3, the resist sensor 8*a* shown in FIG. 1 is turned on, and the clutch 17*a* shown in FIG. 2 is turned off (CLT-OFF).

As can be understood from FIG. 3, during the period T3, in which the sheet of paper is passed through the vertical conveying path 7, the drive current values I3*a*–I3*c* of the motor 15 are greater than the drive current value I2 of the motor during the preceding period T2. The drive current values I3*a*—I3*c* are those of the motor 15 for thick paper, ordinary paper, and thin paper, respectively.

As shown in FIG. 3, during the period T3, the sheet of paper is bent and conveyed at the angled portion A shown in FIG. 1. Accordingly, since the sheet of paper is bent, the conveying load of the motor 15, i.e., the drive current value of the motor 15 increases in comparison with the period T2. As can be understood from FIG. 3, the drive current value I3*a*, which is obtained when the sheet of thick paper is fed, is the largest. The reason for this is that thick paper is the least flexible, and the load required for bending thick paper is the most. Then, as can be understood from FIG. 3, the drive current value I3*c* of the motor 15, which is obtained when thin paper is fed, is the smallest. The reason for this is that thin paper is the most flexible, and the load required for bending thin paper is the least. In addition, as can be understood from FIG. 3, since the flexibility of ordinary paper is between that of thick paper and that of thin paper, the drive current value I3*b* of the motor 15, which is obtained when ordinary paper is fed, is somewhere between the drive current value I3*a* of the motor 15 for thick paper and the drive current value I3*c* of the motor 15 for thin paper.

With such recognition, the MFP of the present embodiment automatically discriminates the thickness of the sheet of paper, and prints the sheet of paper under the process conditions suitable for the sheet of paper based on the discrimination result. This will be described in more detail below.

Figure 4:
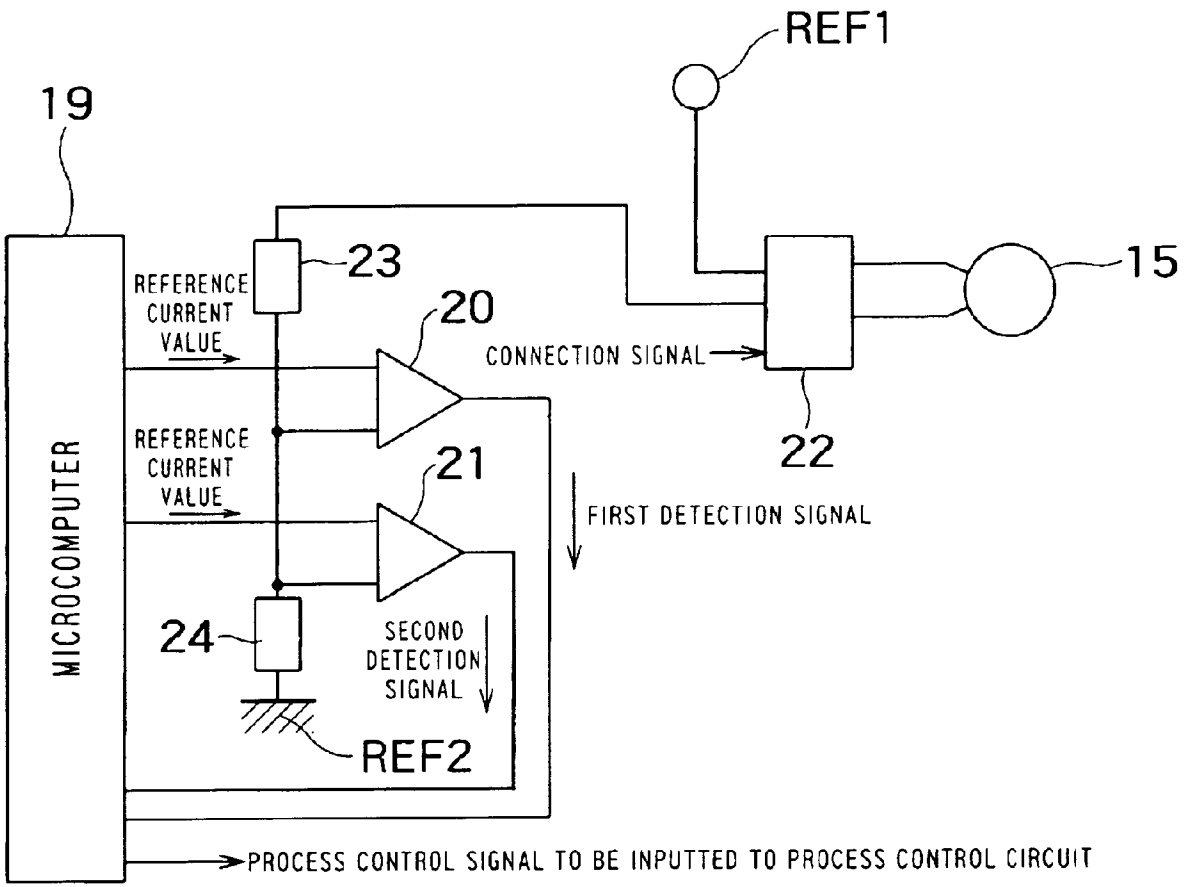
FIG. 4 is a block diagram showing a discrimination circuit for discriminating which type of paper among thick paper, ordinary paper, and thin paper is being fed.

FIG. 4 is a block diagram showing a discrimination circuit for discriminating which type of paper among thick paper, ordinary paper, and thin paper is being fed.

This discrimination circuit discriminates which type of paper among thick paper, ordinary paper, and thin paper is being conveyed using the detected drive current value of the motor 15. Further, this discrimination circuit generates a process control signal corresponding to the thickness of the sheet of paper and sends the signal to a process control circuit.

First, the structure of the discrimination circuit will be described.

As shown in FIG. 4, a motor driver IC 22 for controlling the motor 15 is connected to the motor 15. A connection signal serving as a signal indicating the start of paper feeding is inputted to the motor driver IC 22, as shown in FIG. 4. The motor driver IC 22 drives the motor 15 in response to the connection signal. As shown in FIG. 4, the motor driver IC 22 is connected to a reference voltage REF1, and also connected to a reference voltage REF2 via resistors 23 and 24. A first comparator 20 and a second comparator 21 are connected in parallel with each other between the resistors 23 and 24, as shown in FIG. 4. The first and second comparators 20 and 21 are for monitoring the drive current value of the motor 15. For this purpose, the drive current value of the motor 15 is inputted to each of the first and second comparators 20 and 21 from the motor driver IC 22. Further, an identical reference current value is inputted to each of the first and second comparators 20 and 21 from a microcomputer 19 of the main section 2, as shown in FIG. 4. The reference current value may be set such that the differences among thick paper, ordinary paper, and thin paper can be distinguished. In this case, the reference current value is obtained by adding a design margin to the drive current value of the motor 15 for ordinary paper. The fist comparator 20 compares the drive current value of the motor 15 inputted from the motor driver IC 22 with the reference current value inputted from the microcomputer 19. If the drive current value of the motor 15 is smaller than the reference current value, the first comparator 20 outputs a first detection signal representing thin paper, as shown in FIG. 4. On the other hand, the second comparator 21 compares the drive current value of the motor 15 inputted from the motor driver IC 22 with the reference current value inputted from the microcomputer 19. If the drive current value of the motor 15 is greater than the reference current value, the second comparator 21 outputs a second detection signal representing thick paper, as shown in FIG. 4. In the other cases, no detection signal is outputted from the first and second comparators 20 and 21. The first detection signal outputted from the first comparator 20 and the second detection signal outputted form the second comparator 21 are fed back to the microcomputer 19, as can be understood from FIG. 4. If receiving the first detection signal representing thin paper, the microcomputer 19 recognizes that the paper being conveyed is thin paper. If receiving the second detection signal indicating thick paper, the microcomputer 19 recognizes that the paper being conveyed is thick paper. If receiving neither the first detection signal nor the second detection signal, the microcomputer 19 recognizes that the paper being conveyed is ordinary paper. As shown in FIG. 4, the microcomputer outputs a process control signal corresponding to the first detection signal or the second detection signal to a process control circuit (not shown) for performing process control. Receiving the process control signal, the process control circuit performs process control in accordance with the thickness of paper based on the received process signal.

The discrimination circuit according to the present embodiment can discriminate the thickness of thick paper, ordinary paper, thin paper, and other sheets made of a material other than paper, such as OHP sheets.

Figure 5:
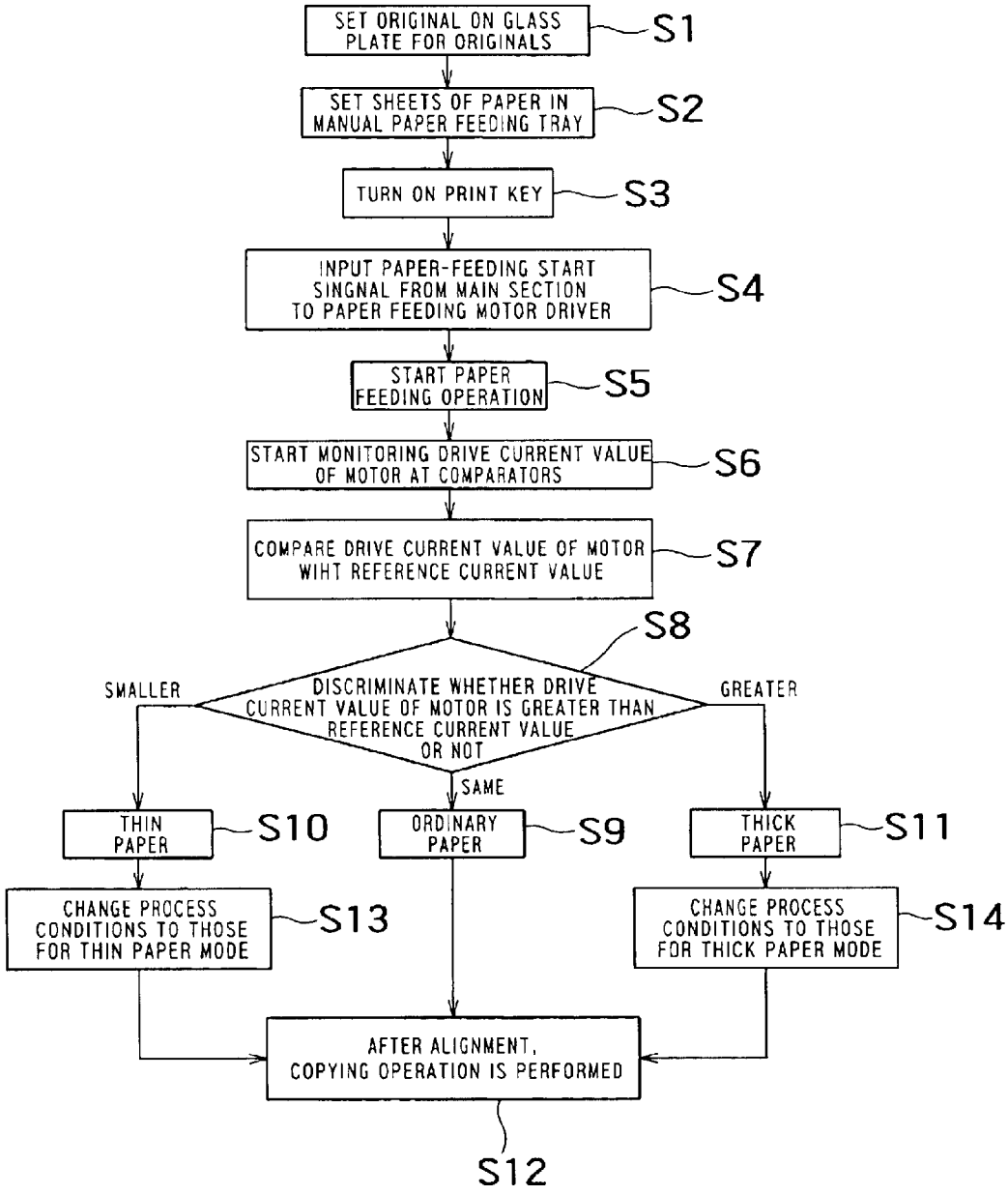
FIG. 5 is a flow chart showing the operation of the discrimination circuit and the process control circuit when a printing operation is performed using the discrimination circuit shown in FIG. 4.

Next, the operation of the discrimination circuit and the process control circuit when the discrimination circuit is used for printing will be described with reference to FIGS. 4 and 5. FIG. 5 is a flow chart showing the operation of the discrimination circuit and the process control circuit when the printing operation is performed using the discrimination circuit shown in FIG. 4.

First, as shown in FIG. 5, an original image to be copied is set on a glass plate for setting originals of the main section 2 shown in FIG. 1 (Step 1). Next, sheets of paper including thick paper, ordinary paper, and thin paper are set in the manual paper feeding tray 3 shown in FIG. 1 (Step 2). Then, the print key button of the main section 2 is turned on (Step 3). With this action, a connection signal is inputted to the motor driver IC 22 (Step 4) to start the paper feeding operation (Step 5), as can be understood from FIG. 5. After the paper feeding operation is started, the drive current value of the motor 15 is inputted from the motor driver IC 22 to each of the first comparator 20 and the second comparator 21 (Step 6). Further, a reference current value is inputted from the microcomputer 19 to each of the first comparator 20 and the second comparator 21. Each of the first comparator 20 and the second comparator 21 compares the drive current value of the motor 15 with the reference current value (Step 7). This will be described in more detail below.

If the first comparator 20 and the second comparator 21 determine that the drive current value of the motor 15 and the reference current value are the same ("Same" in Step 8), no detection signal is outputted from the first comparator 20 and the second comparator 21. Because of this, the microcomputer 19 discriminates that the paper being conveyed is ordinary paper (Step 9). If the first comparator 20 and the second comparator 21 determine that the drive current value of the motor 15 is smaller than the reference current value ("Smaller" in Step 8), only the first comparator 20 outputs the first detection signal, as shown in FIG. 4. The first detection signal is fed back to the microcomputer 19, so that the paper being conveyed is discriminated to be thin paper (Step 10). If the first comparator 20 and the second comparator 21 determine that the drive current value of the motor 15 is greater than the reference current value ("Greater" in Step 8), only the second detection signal is outputted from the second comparator 21, as can be understood from FIG. 4. The second detection signal is fed back to the microcomputer 19, so that the paper being conveyed is discriminated to be thick paper (Step 11).

After the thickness of the paper being conveyed is discriminated, the paper is printed under suitable process conditions in accordance with the thickness thereof. This will be described in more detail below.

If the paper being conveyed is discriminated to be ordinary paper, the paper is printed under the process conditions for ordinary paper, which is the initial mode (Step 12).

If the paper being fed is judged to be thin paper, a process control signal corresponding to thin paper is sent from the microcomputer 19 to a process control circuit (not shown), as can be understood from FIG. 4. The process control circuit changes the process conditions from the initial mode for ordinary paper to the thin paper mode in response to the received process control signal (Step 13). The thin paper is printed under the process conditions in the thin paper mode (Step 12). For example, when thin paper is printed, in the transfer process, the separating output, which is the force to separate paper adhering to the photoconductive drum from the photoconductive drum, is increased in comparison with the case in which ordinary paper is printed.

If the paper being conveyed is discriminated to be thick paper, a process control signal corresponding to thick paper is outputted from the microcomputer 19 to the process control circuit (not shown). The process control circuit changes the process conditions from the initial mode for ordinary paper to the thick paper mode in response to the received process control signal (Step 14). The thick paper is printed under the process conditions in the thick paper mode (Step 12). For example, when the thick paper is printed, in the transfer process, the transfer inflow current value, which is the force to transfer an image formed on the photoconductive drum to a sheet of paper, is increased as compared with the case in which ordinary paper is printed. Further, in the fixing process, the fixing temperature, which is the temperature for fixing toner on the sheet of paper, is increased.

The environment around the area where the MFP is placed is not always the same. For example, the environmental conditions of the area where the MFP is placed, e.g., humidity, change due to the daily weather and/or the operation status of the air conditioner. Generally, the flexibility of printing paper is affected by humidity. For example, the flexibility of a sheet of paper in the area where the humidity is high is increased since the sheet of paper is subjected to moisture. That is, even though the thickness of the paper being conveyed is the same, the conveying load is less in the case where the paper subjected to more moisture is conveyed than in the case where the paper subjected to less moisture is conveyed. Accordingly, when a sheet of paper which is subjected to more moisture than usual is printed, there may arise a problem in that the thickness of paper is discriminated wrongly, and the printing operation is performed under the process conditions suitable for paper having other thickness. In order to avoid this, a humidity sensor for detecting the humidity in the area where the image forming apparatus is placed, or within the image forming apparatus may be provided inside the image forming apparatus to modify the detection data by using the humidity value detected by the humidity sensor when discriminating the thickness of paper. For example, the thickness of paper may be discriminated by modifying the data based on the relationship between the humidity detected by the humidity sensor and the drive current value of the motor. With such an adjustment, the accuracy in discriminating the thickness of paper can be improved.

According to this embodiment, the thickness of paper is automatically discriminated, and based on the discrimination result, a process control is performed which is suitable for the thickness of the paper being printed. Accordingly, a user may print a sheet of paper under the optimum printing conditions for the paper without setting the printing condition in accordance with the thickness of paper by himself/herself. Further, since the drive current value of the motor is used for discriminating the thickness of paper, it is not necessary to newly provide a special sensor to the MFP. Accordingly, since no special modification is made for the existing manual paper feeding unit, the cost for introducing the present embodiment can be minimized.

What is claimed is:

1. An image forming apparatus comprising:

a discrimination circuit for detecting a conveying load at a time by which a sheet, on which an image is to be formed, is conveyed through a curved conveying path, for discriminating a thickness of the sheet based on a detected value of the conveying load, and for generating a process control signal in order to carry out a process control suitable for the thickness of the sheet based on the discriminated thickness; and a process control circuit for carrying out the process control suitable for the thickness of the sheet in response to the process control signal received, wherein said discrimination circuit is capable of detecting, as the conveying load, a load of a motor for rotating a roller for conveying the sheet.

2. The image forming apparatus according to claim 1, wherein said discrimination circuit is capable of detecting, as the load of the motor, a drive current value of the motor.

3. The image forming apparatus according to claim 2, wherein said discrimination circuit compares the drive current value of the motor with a predetermined reference value, to selectively discriminate the thickness of the sheet.

4. An image forming apparatus comprising:

a discrimination circuit for detecting a conveying load at a time by which a sheet, on which an image is to be formed, is conveyed through a curved conveying path, for discriminating a thickness of the sheet based on a detected value of the conveying load, and for generating a process control signal in order to carry out a process control suitable for the thickness of the sheet based on the discriminated thickness; and a process control circuit for carrying out the process control suitable for the thickness of the sheet in response to the process control signal received, wherein said discrimination circuit compares the detected value of the conveying load with a predetermined reference value, to selectively discriminate the thickness of the sheet.

5. The image forming apparatus according to claim 4, wherein said discrimination circuit discriminates whether the sheet is thick paper, ordinary paper, or thin paper on the base of the thickness of the sheet discriminated using, as the predetermined reference value, the detected value of the conveying load when the ordinary paper is being conveyed.

6. An image forming apparatus in which ordinary paper is fed from a cassette paper feeding unit installed in a main section in order to print an image thereon, thick paper and thin paper are fed from a manual paper feeding unit in order to print an image thereon, said manual paper feeding unit being for manually feeding paper from outside of the main section, and process conditions for ordinary paper are set to be an initial mode, said image forming apparatus comprising:

a discrimination circuit for detecting a conveying load when a sheet fed from the manual paper feeding unit passes through a curved conveying path, for discriminating a thickness of the sheet based on a detected value of the conveying load, and when the sheet is discriminated to be the thick paper or the thin paper, for generating a process control signal for carrying out a process control suitable for the thickness of the paper; and a process control circuit for carrying out the process control suitable for the thick paper or the thin paper based on the process control signal received.

* * * * *